US008800068B2

(12) United States Patent
Liu

(10) Patent No.: US 8,800,068 B2
(45) Date of Patent: Aug. 12, 2014

(54) AIR VENTILATED PROTECTION SUIT

(75) Inventor: Jiann-Maw Liu, Taipei (TW)

(73) Assignee: Rite Safety Asso. Corp., Taipei (TW)

( * ) Notice: Subject to any disclaimer, the term of this patent is extended or adjusted under 35 U.S.C. 154(b) by 313 days.

(21) Appl. No.: 13/447,444

(22) Filed: Apr. 16, 2012

(65) Prior Publication Data

US 2013/0269090 A1 Oct. 17, 2013

(51) Int. Cl.
*A41D 13/00* (2006.01)

(52) U.S. Cl.
USPC ..... 2/457

(58) Field of Classification Search
CPC . A62B 17/006; A41D 13/00; A41D 13/0025; A41D 27/202; A41D 13/12
USPC ..... 2/2.14, 2.15, 456, 457, 2.11; 128/201.25; 138/30
See application file for complete search history.

(56) References Cited

U.S. PATENT DOCUMENTS 3,049,896 A * 8/1962 Webb ..... 128/201.25
3,448,463 A * 6/1969 Milone ..... 2/234
4,112,556 A * 9/1978 Flaum et al. ..... 24/382
8,095,994 B2 * 1/2012 Natonson et al. ..... 2/102

* cited by examiner

*Primary Examiner* — Khoa Huynh
*Assistant Examiner* — Anna Kinsaul
(74) *Attorney, Agent, or Firm* — WPAT, PC; Justin King

(57) ABSTRACT

An air ventilated protection suit includes an air input port, and a flat air duct connected to an inner end of the air input port. The flat air duct has hoses provided therein to separately extend in directions along which air is delivered to a whole interior of the protection suit. The hoses keep the flat air duct in an always unimpeded state, and respectively include an axially extended spiral cut, such that air supplied into the hosts pushes open the spiral cuts to flow from the hosts into the flat air duct via the push-opened spiral cuts. The protection suit also includes an inspection port to allow an air-tightness inspection of the protection suit before a wearer entering into a working environment; and an air-guiding case fitted around each pressure relief valve provided on the protection suit to provide a space for air released from the pressure relief valve.

6 Claims, 9 Drawing Sheets

AIR VENTILATED PROTECTION SUIT

FIELD OF THE INVENTION

The present invention relates to an air ventilated protection suit, which can be filled with air to have internal pressure higher than ambient pressure, so as to safely protect a wearer against hazardous particles, toxic gas, bacteria or virus in a working environment.

BACKGROUND OF THE INVENTION

In industrial and medical researches as well as in many manufacturing processes for different products, some health-hazardous particles will be produced to exist in the working environment. Therefore, persons engaging in such researches or product manufacture must wear a protection suit in the working environment to isolate the particle from the wearers, and particularly to prevent the particles from entering the wearers' bodies via respiration.

After a wearer has put on the protection suit, air must be immediately supplied into the protection suit, so that there is sufficient oxygen-containing air in the protection suit for the wearer to breathe in. Therefore, it is an important and basic requirement that air can be quickly supplied into the protection suit. Generally, a protection suit is internally provided with a duct for guiding air to four limbs of the protection suit. The duct consists of an upper and a lower plastic sheet that are adhered to each other along their two lateral edges, so that a normally flat duct is formed. When the protection suit is stored in an environment with relatively high temperature and humidity, the upper and lower sheets of the duct will very possibly become attached to each other to result in a blocked duct, which no doubt seriously adversely affects the important operation of quickly supplying air into the protection suit.

Meanwhile, to protect the wearer against the health-hazardous instantaneous high pressure in the protection suit caused by movements of the wearer during work, check valves are provided on the protection suit so that the air that causes the instantaneous high pressure can be discharged from the protection suit via the check valves.

SUMMARY OF THE INVENTION

A primary object of the present invention is to provide an air ventilated protection suit that ensures an internal air duct thereof is always in an unimpeded state for delivering air, so as to quickly complete the supply of air into the protection suit.

Another object of the present invention is to provide an air ventilated protection suit that includes an inspection port to enable an air-tightness inspection of the protection suit before a wearer can safely enter a working environment.

A further object of the present invention is to provide an air ventilated protection suit that includes an air-guiding case fitted around each pressure relief valve provided on the protection suit, so that air released from the pressure relief valves can be successfully guided out of the protection suit.

To achieve the above and other objects, the air ventilated protection suit according to the present invention includes an air input port, and a flat air duct connected to an inner end of the air input port. The flat air duct has hoses provided therein to separately extend in directions along which air is delivered to a whole interior of the protection suit. The hoses respectively include an axially extended spiral cut, such that air supplied via the air input port into the hoses pushes open the spiral cuts to flow from the hoses into the flat air duct via the push-opened spiral cuts.

The flat air duct can have four hoses provided therein, and the four hoses separately extend from the inner end of the air input port to four limbs of the protection suit.

The protection suit further has pressure relief devices provided thereon. Each of the pressure relief devices includes a pressure relief valve and an air-guiding case. The air-guiding case is a substantially flat case configured for inserting in a pocket on the protection suit and having front and rear open ends with at least four bars provided at the front open end to prevent the same from deformation. And, the pressure relief valve is introduced into the air-guiding case.

The air-guiding case includes a top plate being provided at a rear end with four air outlets, and a bottom plate being provided at a rear end with a notch. And, the pressure relief port on the protection suit is arranged at a position corresponding to the notch on the bottom plate of the air-guiding case.

The protection suit further has an inspection port and a plug for sealing the inspection port; and the plug is connected to an outer wall of the inspection port via a flexible belt.

The protection suit further includes an entry/exit opening, which is openable via a zipper for a wearer to put on the protection suit; and a seal flap set provided on an outer side of the entry/exit opening to prevent air from entering the protection suit via the entry/exit opening. The seal flap set includes a left flap and a right flap, which can be fastened to each other to prevent air from entering the protection suit via the entry/exit opening; and the left and right flaps of the seal flap set are fastened to each other at a position offset from the zipper on the entry/exit opening.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
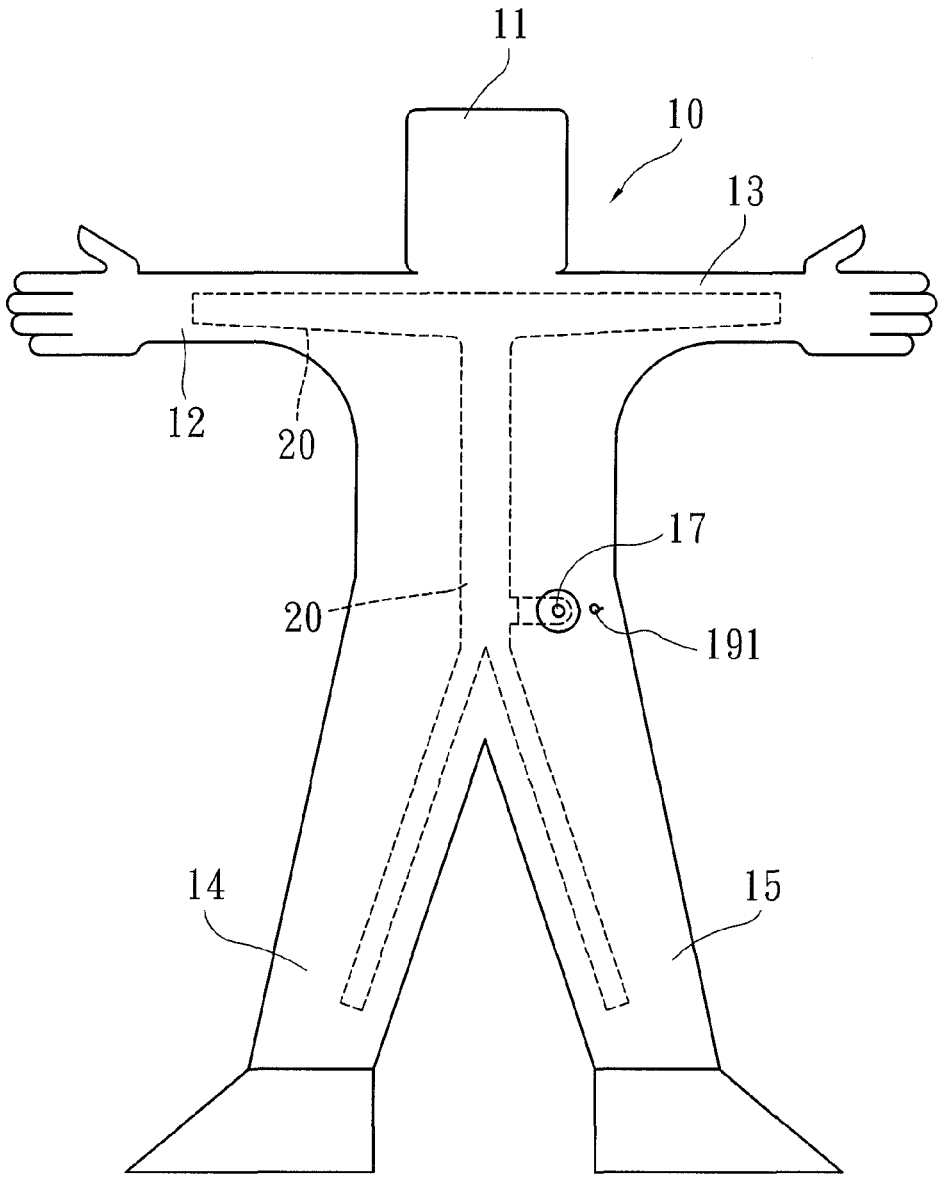
FIG. 1 is a front view of an air ventilated protection suit according to a preferred embodiment of the present invention.
Figure 2:
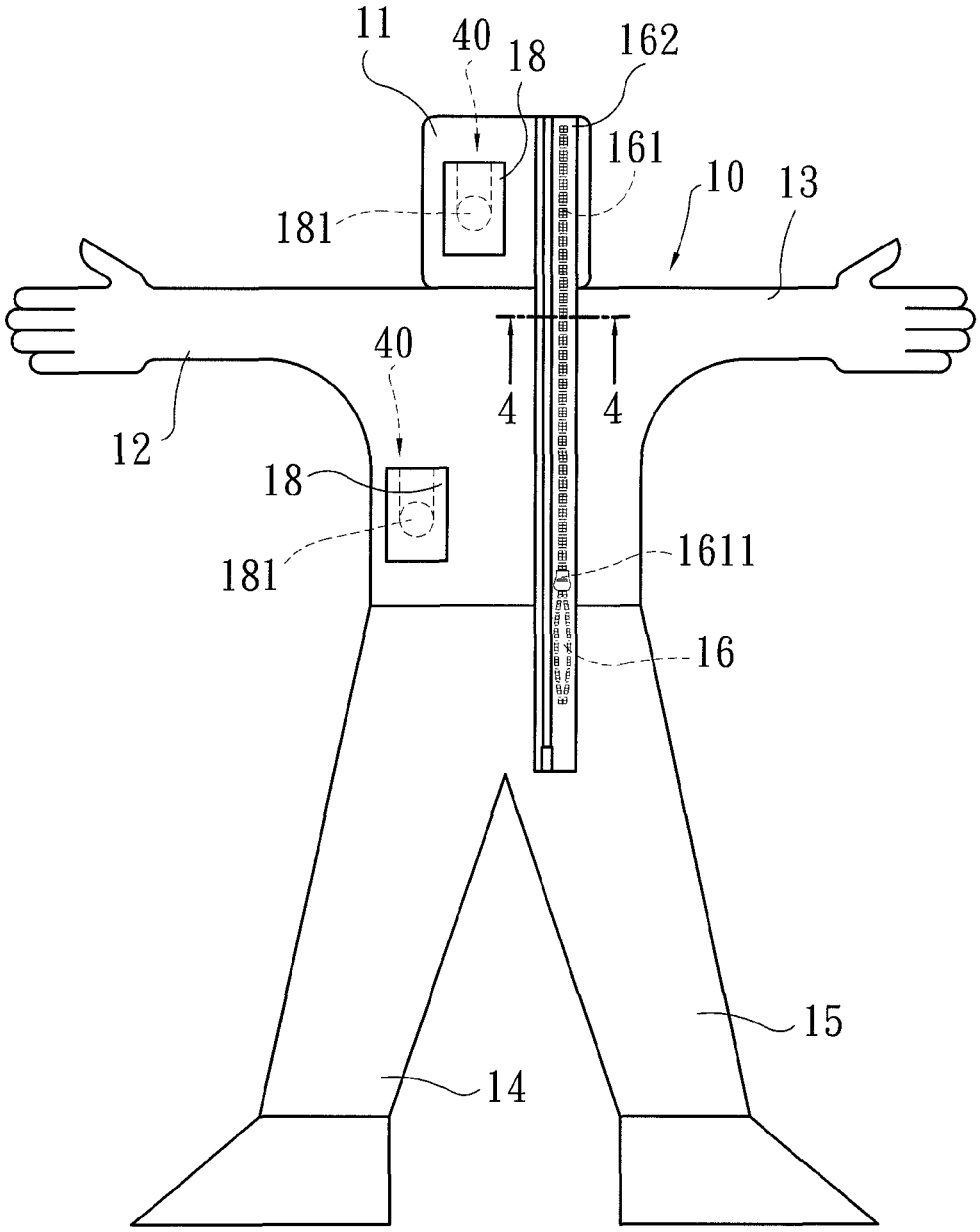
FIG. 2 is a rear view of the air ventilated protection suit of FIG. 1.

Please refer to FIGS. 1 to 4. An air ventilated protection suit according to a preferred embodiment of the present invention is a one-piece protection suit 10 with an integral hood 11 providing sufficient space for head. The protection suit 10 includes an entry/exit opening 16, via which a wearer puts on the protection suit 10. A seal flap set 162 is provided on an outer side of the entry/exit opening 16 to prevent air from entering the protection suit 10 via the entry/exit opening 16. The entry/exit opening 16 is provided with a zipper 161 for opening or closing the entry/exit opening 16. The seal flap set 162 includes a left flap 1621 and a right flap 1622, which can be fastened to each other to achieve the purpose of preventing air from entering the protection suit 10. The left and right flaps 1621, 1622 of the seal flap set 162 are fastened to each other at a position offset from the zipper 161, so that a slide 1611 of the zipper 161 does not press against and accordingly force open the fastening position of the left and right flaps 1621, 1622 to cause air leak of the protection suit 10 at the entry/exit opening 16.

Figure 3:
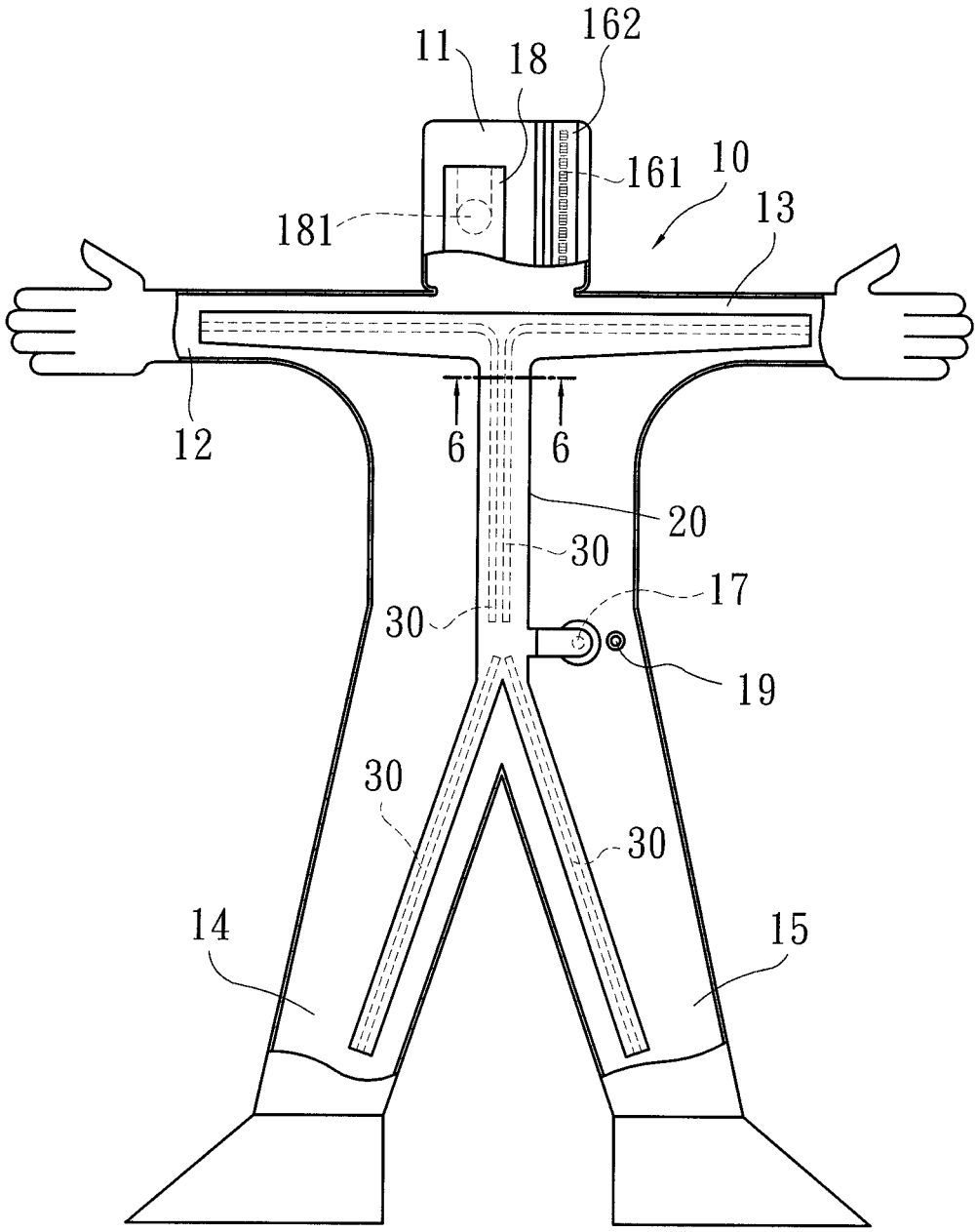
FIG. 3 is a partial sectional view of FIG. 2 viewed from a front side thereof.
Figure 5:
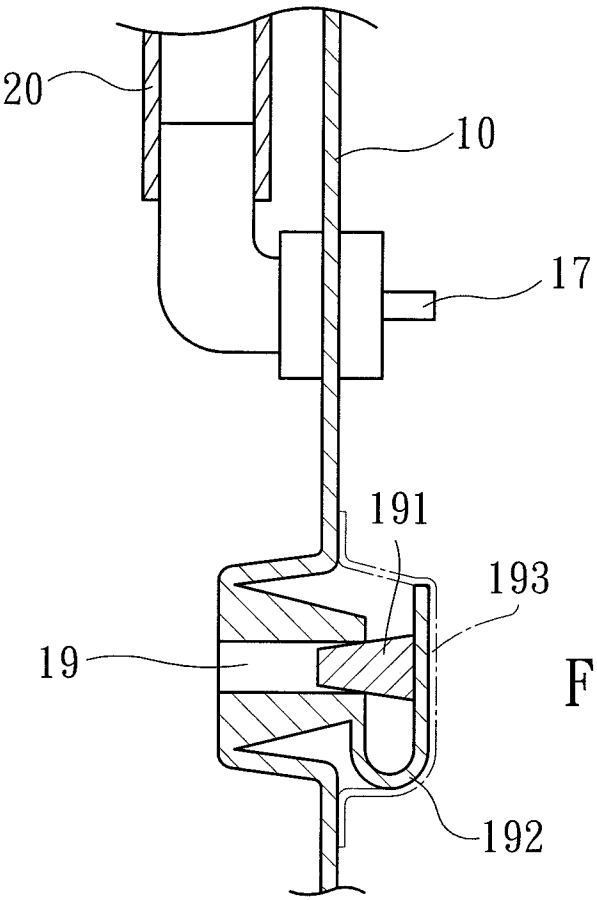
FIG. 5 is a fragmentary sectional view of an air input port and an inspection port for the air ventilated protection suit of FIG. 1.
Figure 4:
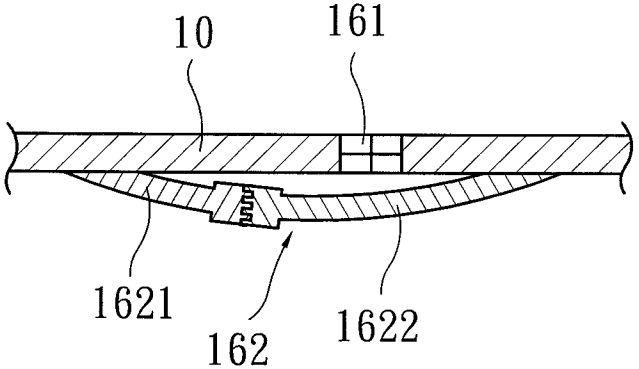
FIG. 4 is an enlarged sectional view taken along line 4-4 of FIG. 2.
Figure 6:
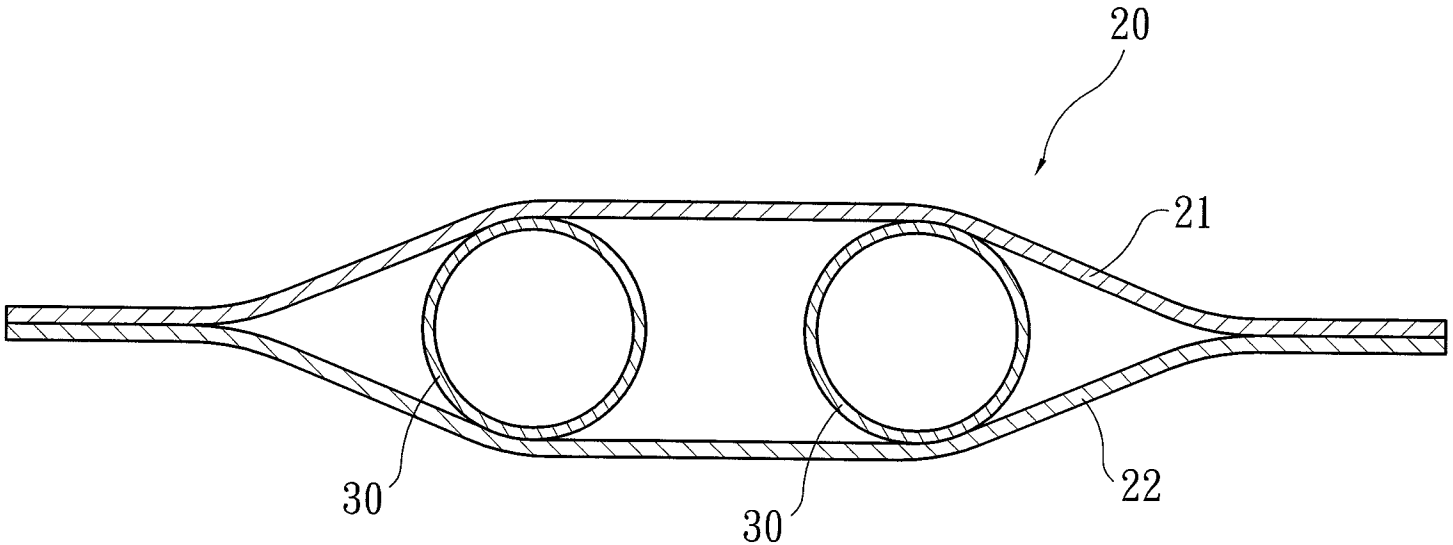
FIG. 6 is an enlarged sectional view taken along line 6-6 of FIG. 3.

Please also refer to FIGS. 3 and 5. The protection suit 10 is provided with an air input port 17, which is connectable with an air hose of an air supply device (not shown) for delivering oxygen-containing air into the protection suit 10, so that the protection suit 10 has internal pressure higher than the air pressure in a working environment. The air supply device can be an air compressor or a powered inflation device. The air input port 17 has an inner end connected to a flat air duct 20, which delivers the supplied oxygen-containing air to four limbs 12, 13, 14, 15 of the protection suit 10. As can be seen in FIG. 6, the air duct 20 consists of an upper and a lower plastic sheet 21, 22, which are adhered to each other along two lateral edges thereof to thereby form the flat air duct 20. The flat air duct 20 is internally provided with hoses 30, which extend in the flat air duct 20 in a direction along which air is delivered. With the hoses 30, the upper and lower sheets 21, 22 of the air duct 20 are always spaced from each other at a transversely middle portion thereof without the risk of becoming completely adhered together when the protection suit 10 is folded for storage, particularly in a high-temperature and high-humidity environment. In this way, it can be ensured the air duct 20 is always in an unimpeded state, allowing quick delivery of the oxygen-containing air to the limbs 12, 13, 14, 15 and a whole internal space of the protection suit 10.

Figure 7:
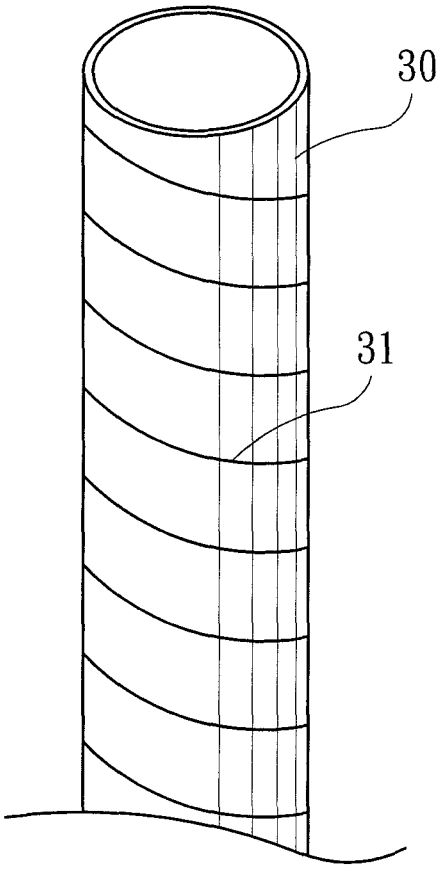
FIG. 7 is a fragmentary perspective view of a hose for the air ventilated protection suit of the present invention.
Figure 8:
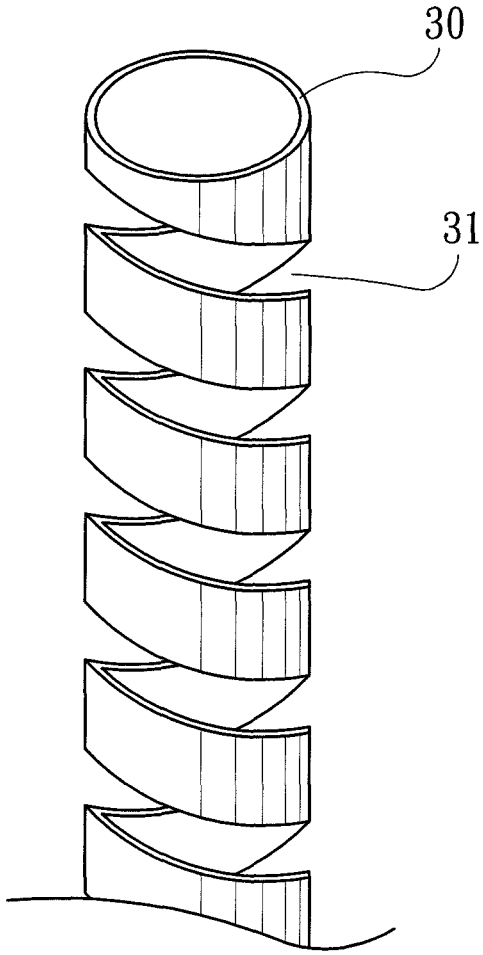
FIG. 8 shows the hose of FIG. 7 when air is supplied therethrough.

FIGS. 7 and 8 show the hose 30 for the protection suit 10. As shown in FIG. 7, the hose 30 includes an axially extended spiral cut 31. When the oxygen-containing air is supplied into the hose 30, the spiral cut 31 on the hose 30 is pushed open by the air pressure, as shown in FIG. 8, so that the air flows from the hose 30 into the air duct 20 via the opened spiral cut 31 and the air delivery rate is not adversely affected at all.

Four hoses 30 can be provided in the flat air duct 20 to separately extend from the inner end of the air input port 17 to the four limbs 12, 13, 14, 15.

The wearer will move his or her body, limbs and head during work. Some of the wearer's movements might squeeze the air in the protection suit 10 to form instantaneous high internal pressure therein. To avoid causing any possible discomfort to the wearer by the high internal pressure, the protection suit 10 includes pressure relief devices 40 arranged at the hood 11 and the back thereof for discharging the air that causes the instantaneous high pressure. The protection suit 10 also includes pockets 18, in which the pressure relief devices 40 are positioned.

Figure 9:
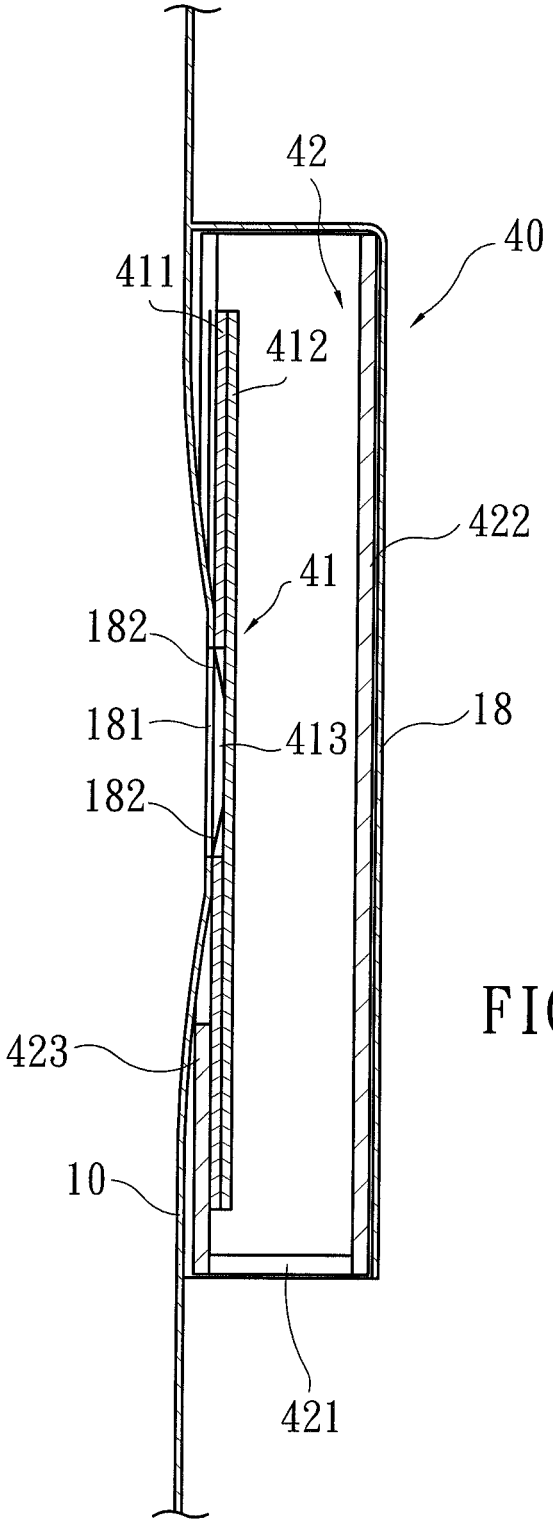
FIG. 9 is a sectional view of a pressure relief device for the air ventilated protection suit of the present invention.
Figure 10:
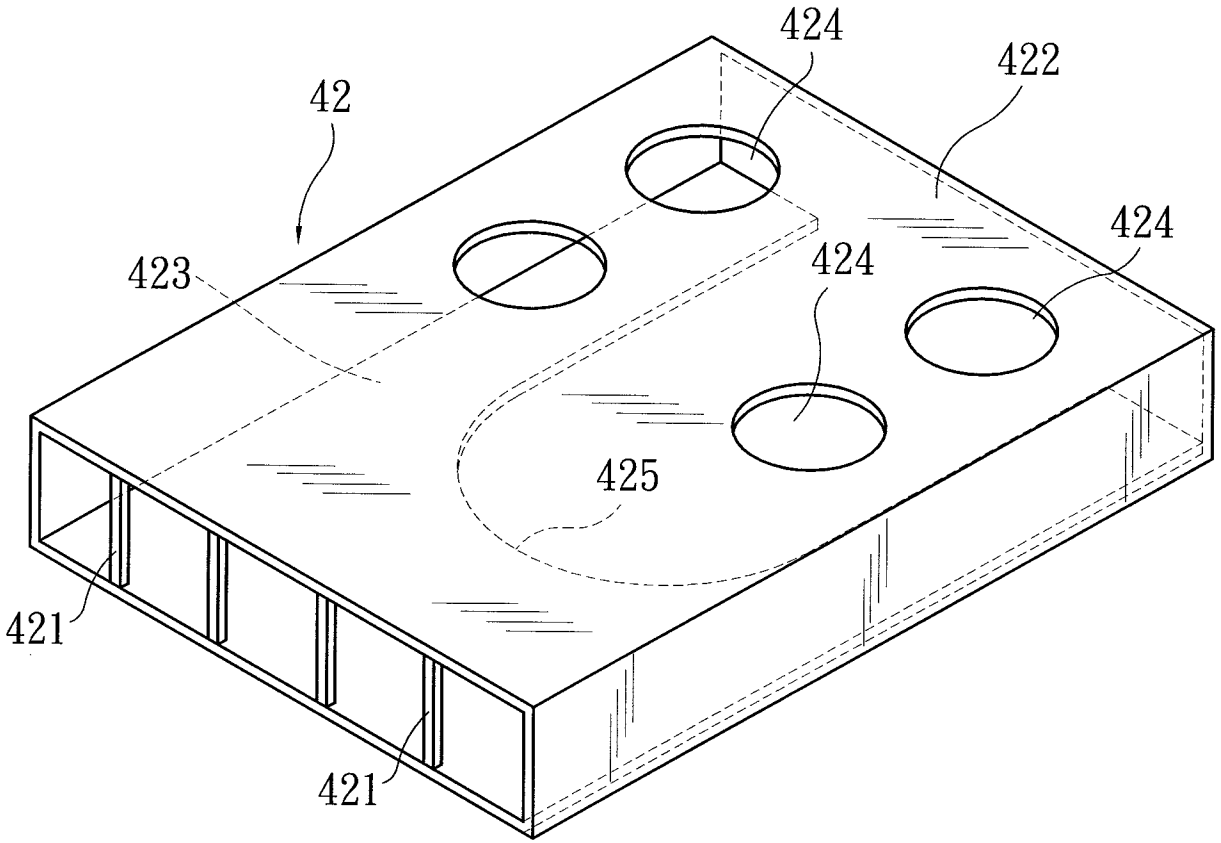
FIG. 10 is a perspective view of an air-guiding case for the pressure relief device of FIG. 9.
Figure 11:
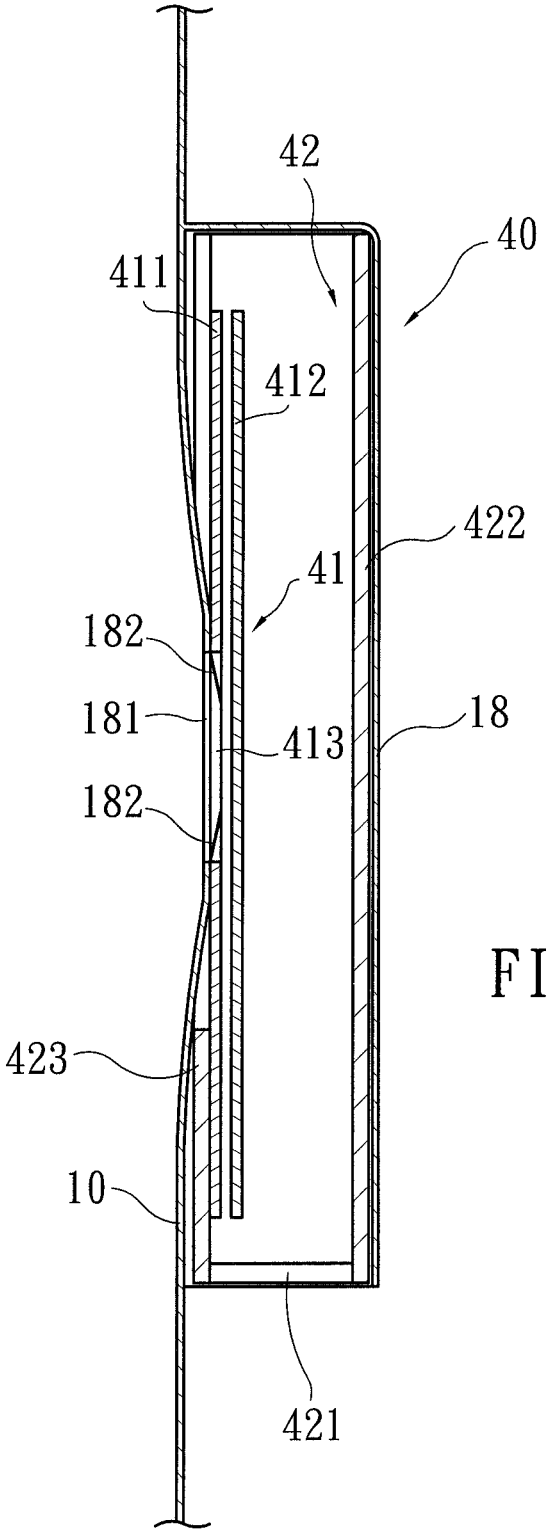
FIG. 11 is a sectional view showing the pressure relief device of FIG. 9 in a pressure relieving position.

Please refer to FIGS. 9 and 10. Each of the pressure relief devices 40 includes a pressure relief valve 41 and an air-guiding case 42. The pressure relief valve 41 includes a first thin sheet 411 and a second thin sheet 412. The first thin sheet 411 has an aperture 413, which is in close contact with a pressure relief port 181 provided on the protection suit 10. The second thin sheet 412 is superimposed on the first thin sheet 411 with four corners of the two thin sheets 411, 412 fixedly connected to one another, so as to seal the pressure relief port 181. Each of the pressure relief ports 181 on the protection suit 10 includes a diaphragm 182, which is able to prevent the air in the protection suit 10 from leaking out via the pressure relief port 181 in normal condition. Since the pressure relief valve 41 is a known skill and not a feature of the present invention, it is not discussed in more details herein. The air-guiding case 42 is a substantially flat case having front and rear open ends. At least four bars 421 are provided at the front open end of the air-guiding case 42 for preventing the front open end from deformation. The air-guiding case 42 is configured for inserting in the pocket 18 on the protection suit 10, and the pressure relief valve 41 is introduced into the air-guiding case 42. When the air released from the protection suit 10 via the pressure relief port 181 flows through the aperture 413 of the pressure relief valve 41, the released air swells a space between the first thin sheet 411 and the second thin sheet 412, allowing the air to be discharged from between the first and the second thin sheet 411, 412. The air-guiding case 42 has an internal space sufficient for the first and the second thin sheet 411, 412 to complete the movement of swelling to release air.

The air-guiding case 42 includes a top plate 422 and a bottom plate 423. The top plate 422 is provided near a rear end with four air outlets 424, via which the air released via the pressure relief valve 41 is guided to the top of the air-guiding case 42, lest the released air should have an adverse influence on the swelling state of the space between the first thin sheet 411 and the second thin sheet 422. The bottom plate 423 has a notch 425 formed at a rear end thereof. The pressure relief port 181 on the protection suit 10 is located at a position corresponding to the notch 425.

After a wearer has put on the protection suit 10, it is necessary to ensure the protection suit 10 is perfect without any leak hole or fissure. Any leak hole or fissure resulting in air leak would endanger the wearer's life, safety or health. Please refer to FIG. 5. The protection suit 10 of the present invention is provided with an inspection port 19 and a plug 191 for sealing the inspection port 19. The plug 191 is connected to an outer wall of the inspection port 19 via a flexible belt 192, such that the plug 191 can be integrally connected to the protection suit 10. Before the wearer entering into the working environment, the plug 191 is unplugged from the inspection port 19, and a pressure gauge (not shown) is connected to the inspection port 19 to measure the internal pressure of the protection suit 10. When the measured internal pressure is in a constant state, it indicates the protection suit 10 is airtight. After the pressure inspection is completed, the plug 191 is plugged in the inspection port 19 again to seal the same. The protection suit 10 may be further provided with an openable sealing member 193 for covering over an outer side of the inspection port 19 and the plug 191. Before the sealing member 193 is opened, external air is stopped from entering into a space between the sealing member 193 and the protection suit 10. Before entering into the working environment, the wearer may determine whether to inspect the protection suit 10 or not. In the case the wearer decides to inspect the protection suit 10 before entering into the working environment, he or she may do the inspection simply by tearing open the sealing member 193. On the other hand, when the wearer decides not to inspect the protection suit 10, he or she may leave the sealing member 193 in its originally sealed state.

The air ventilated protection suit provided by the present invention is characterized in that the flat air duct has spirally cut hoses arranged therein to ensure smooth flowing of air through the air duct to the entire interior of the protection suit, the inspection port enables a safety inspection of the protection suit before the wearer entering into the working environment, and the air-guiding case ensures normal operation of the pressure relief valve.

The present invention has been described with a preferred embodiment thereof and it is understood that many changes and modifications in the described embodiment can be carried out without departing from the scope and the spirit of the invention that is intended to be limited only by the appended claims.

What is claimed is:

1. An air ventilated protection suit comprising an entry/exit opening, which is openable via a zipper for a wearer to put on the protection suit; a seal flap set provided on an outer side of the entry/exit opening to prevent air from entering the protection suit via the entry/exit opening; an air input port; a flat air duct connected to an inner end of the air input port for delivering air to four limbs of the protection suit; and pressure relief devices for releasing air that causes instantaneous high internal pressure in the protection suit; characterized in a plurality of hoses provided in the flat air duct to separately extend in directions along which air is delivered; the hoses respectively including an axially extended spiral cut, such that air supplied into the hoses pushes open the spiral cuts on the hoses to flow from the hoses into the air duct via the push-opened spiral cuts, and wherein the flat air duct has four hoses provided therein, and the four hoses separately extend from the inner end of the air input port to the four limbs of the protection suit.

2. The air ventilated protection suit as claimed in claim 1, wherein the pressure relief devices are separately positioned in pockets provided on the protection suit, and respectively include a pressure relief valve and an air-guiding case; the pressure relief valve including a first thin sheet and a second thin sheet, the first thin sheet having an aperture in close contact with a pressure relief port formed on the protection suit; the second thin sheet being superimposed on the first thin sheet with four corners of the two thin sheets fixedly connected to one another for sealing the pressure relief port; the air-guiding case being a substantially flat case configured for inserting in the pocket on the protection suit and having front and rear open ends, with at least four bars being provided at the front open end for preventing the same from deformation; and the pressure relief valve being introduced into the air-guiding case.

3. The air ventilated protection suit as claimed in claim 2, wherein the air-guiding case includes a top plate being provided at a rear end with four air outlets, and a bottom plate being provided at a rear end with a notch; and the pressure relief port on the protection suit being arranged at a position corresponding to the notch on the bottom plate of the air-guiding case.

4. The air ventilated protection suit as claimed in claim 1, further comprising an inspection port and a plug for sealing the inspection port; and the plug being connected to an outer wall of the inspection port via a flexible belt.

5. The air ventilated protection suit as claimed in claim 4, further comprising an openable sealing member covered over an outer side of the inspection port and the plug, such that external air is stopped from entering into a space between the sealing member and the protection suit before the sealing member is opened.

6. The air ventilated protection suit as claimed in claim 1, wherein the seal flap set includes a left flap and a right flap, which can be fastened to each other to prevent air from entering the protection suit via the entry/exit opening; and the left and right flaps of the seal flap set being fastened to each other at a position offset from the zipper on the entry/exit opening.

* * * * *